US005277921A

United States Patent [19]

Yamamatsu et al.

[11] Patent Number: 5,277,921

[45] Date of Patent: Jan. 11, 1994

[54] MEAT PRODUCT CASING AND METHOD OF PRODUCING THE SAME

[75] Inventors: Takeyuki Yamamatsu, Tokyo; Teiichi Matsumoto; Kiyonori Iwasa, both of Hisai, all of Japan

[73] Assignee: Towa Kako Co., Ltd., Tokyo, Japan

[21] Appl. No.: 847,680

[22] Filed: Mar. 5, 1992

[30] Foreign Application Priority Data

Mar. 7, 1991 [JP] Japan ..... 3-019630[U]

[51] Int. Cl.[5] ..... A22C 13/00

[52] U.S. Cl. ..... 426/135; 138/118.1; 427/394; 427/395; 427/396; 428/34.8

[58] Field of Search ..... 426/105, 135, 415, 138; 138/118.1; 428/34.8; 427/394, 395, 396

[56] References Cited

U.S. PATENT DOCUMENTS

| | | | |
|---|---|---|---|
| 3,519,470 | 7/1970 | Gordon et al. | 427/394 |
| 3,539,361 | 11/1970 | Coleman | 426/135 X |
| 3,905,397 | 9/1975 | Chiu | 138/118.1 |
| 4,442,868 | 4/1984 | Smith et al. | 426/135 X |
| 5,089,307 | 2/1992 | Ninomiya et al. | 426/138 X |

FOREIGN PATENT DOCUMENTS

| | | | |
|---|---|---|---|
| 2336884 | 7/1977 | France | 426/135 |

*Primary Examiner*—Arthur L. Corbin
*Attorney, Agent, or Firm*—Michael J. Striker

[57] ABSTRACT

A casing for a meat product is prepared by impregnating and filling meshes of a breathable fibrous food casing sheet with a polysaccharide and then drying the sheet.

9 Claims, 2 Drawing Sheets

MEAT PRODUCT CASING AND METHOD OF PRODUCING THE SAME

BACKGROUND OF THE INVENTION

The present invention relates to a food product casing and a food product therewith, and also to methods of producing the same.

Food products such as ham, sausage, etc. wrapped in casing material are well known.

Fibrous casing and cellulose casings are generally used for wrapping the above mentioned meat products, such as a ham, a sausage, etc. Such casings provide good manufacturability of a product during smoking due to their breathability which is substantially different from the breathability of other synthetic film casings. The casing having the above specified characteristics are produced by coating or filming and impregnating with viscose. However, for impregnating with viscose some troublesome procedures are required such as regeneration, rinsing, neutralization by desulphurization, flexibility adding treatments, etc. In practice, the acid, alkali, rinsing and flexibility adding treatments during processing of meat remarkably decrease the productivity.

Furthermore, there is another problem in generation of hydrogen sulfide, carbon disulfide, etc. Since regenerated cellulose adheres to the surface of the meat product, peeling treatment must be applied for easy separation of the casing from the meat. In addition, the casing sheet must be mechanically extended while it is dry so as to follow both temperature changes in its boiling and smoking. Otherwise, the casing surface of the meat product would wrinkle and spoil the product value.

On the other hand, various edible films impregnated with polysaccharide such as vegetable gelatine, alkynecarboxylic acid, carrageenan in conventional methods are widely known. However, it is not known to apply polysaccharide of this type to the casings for hams, sausages, and the like.

SUMMARY OF THE INVENTION

Accordingly, it is an object of the present invention to provide a food product casing and a food product therewith and also methods of producing the same which avoid the disadvantages of the prior art.

More particularly, it is an object of the present invention to provide the above methods and products such that troublesome procedures in processing of meat are dispensed with, the durability of the product is improved, and productivity during boiling and smoking a product is increased.

In keeping with these objects and with others which will become apparent hereinafter, one feature of the present invention resides, briefly stated, in a method of producing a food product casing and a food product therewith as well as to the casing and the food product, in accordance with which a breathable fibrous substrate is impregnated with a polysaccharide solution and then dried.

The impregnation can be performed for example by coating the breathable fibrous substrate with the polysaccharide solution or by dipping the substrate into the polysaccharide solution.

The thusly prepared casing then wraps a processed food, such as a ham, a sausage and the like, or bent so that opposite right and left portions of the sheet are overlapped and enveloped for boiling and smoking a ham, a sausage and the like.

The materials which can be used for the casing of the thusly produced food product are Japanese paper, unwoven cloth, cotton cloth, etc. Also, chemical fibers, synthetic paper and unwoven cloth can be used as well, to form a substrate of the casing.

The polysaccharides which are used for method and the food product of the present invention are carrageenan, alkylnecarboxylic acid, gum arabic, mannan, arabinogalactan, pectin tamarind gum, guar gum, locust bean gum, tata gum, psyllium seed gum, chitin, xanthan gum, pullulan, etc. The above mentioned materials can be in form of either a simple substance or their composites.

The amount of the impregnating polysaccharide must be sufficient to completely fill all the meshes of the substrate to make a uniform film. For example, it is necessary to coat the polysaccharide of 10–100 $g/m^2$ (weight in the solid state) on the paper like Japanese paper, etc., and 20–200 $g/m^2$ on the unwoven cloth depending on its thickness.

The novel features which are considered as characteristic for the invention are set forth in particular in the appended claims. The invention itself, however, both as to its construction and its method of operation, together as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
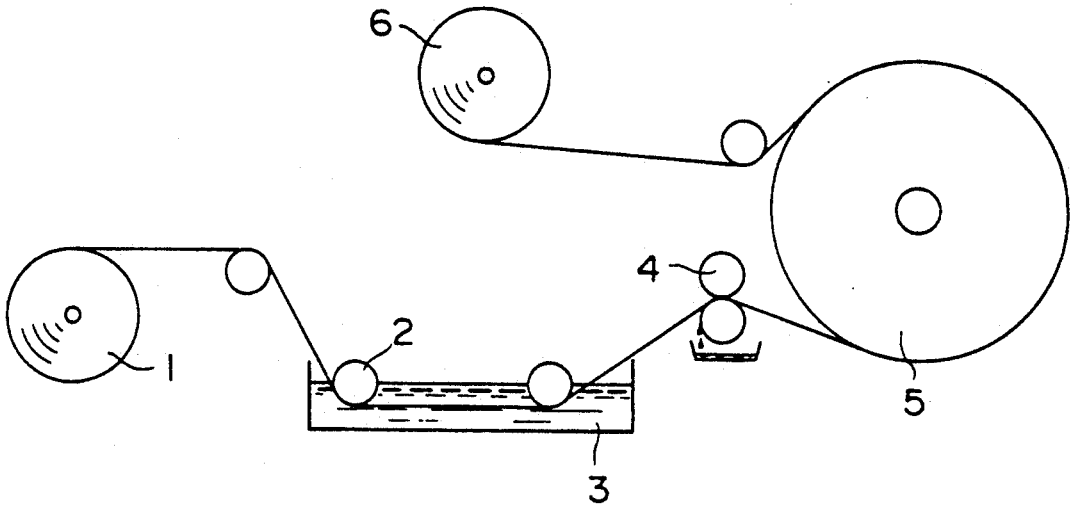
FIG. 1 is a view schematically illustrating a method of producing a food product casing and a food product therewith in accordance with the present invention.

In accordance with a method of producing an inventive food product, a band 1 composed of a fibrous material, such as for example Japanese paper, unwoven cloth, cotton cloth, etc. is unrolled from a supply roller and supplied to a polysaccharide bath 3. In the polysaccharide bath 3 the band 1 is guided over guide rolls 2 and dipped into the polysaccharide bath 3. The polysaccharide solution of the bath uniformly impregnates at least the surface of the band 1, and thereafter the band is supplied to a roll pair 4. The band 1 impregnated with the polysaccharide solution passes between the compression rolls 4 and the excess of the polysaccharide solution is thereby removed. Then the band is guided to a drier 5, is dried by the drier and then rolled up with a product winder 6 to form a roll of the casing band.

Figure 2:
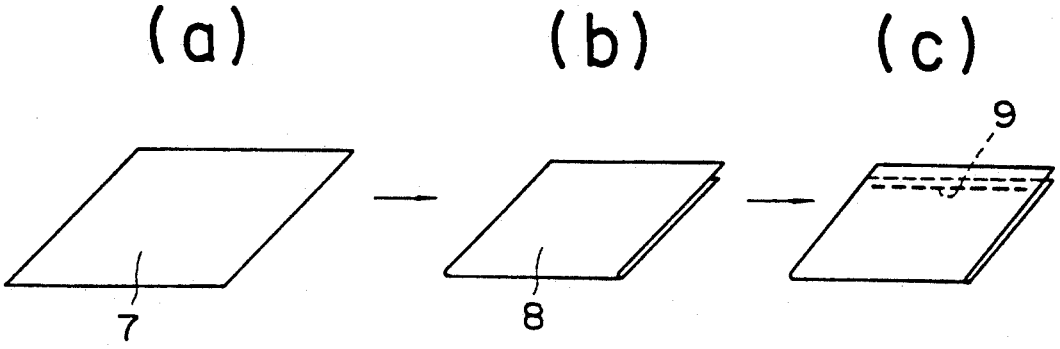
FIGS. 2*a*, 2*b* and 2*c* are perspective views showing examples of casings for the food product of the present invention.

A comparatively wide sheet of the casing material produced in the method of FIG. 1 may be then cut into a casing sheet 7 of appropriate width and length for wrapping a ham, a sausage, and the like. The above wide sheet 1 may be also cut into a casing sheet of appropriate dimensions, which is folded double as identified with reference numeral 8 and sewn at its edges by a seam 9 to make a cylinder for smoking a ham, a sausage, and the like in it (FIGS. 2*a*–2*c*).

Figure 3:
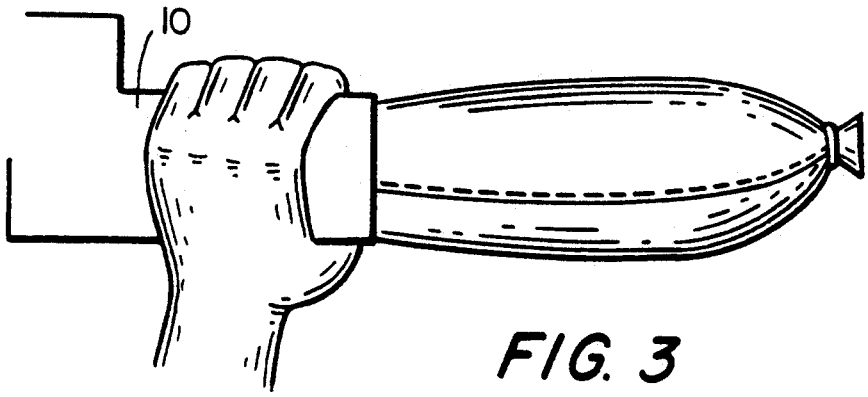
FIGS. 3 and 4 are views showing the steps of producing a final food product.
Figure 4:
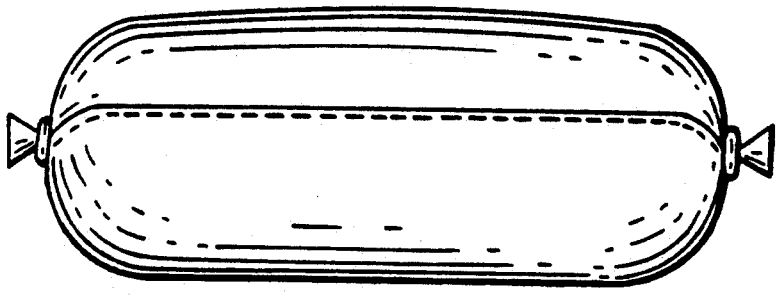

Final products are produced with the use of the casing described hereinabove, which is then filled with with meat such as a ham, a sausage, etc., for example by a stuffer having a nozzle. Two of such products are shown in FIGS. 3 and 4.

Hereinbelow several examples are given to illustrate the inventive method and food product.

EXAMPLE 1

A Japanese paper of 20 g/m$^2$ was coated and impregnated at the rate of 250 g/m$^2$ with 8% carrageenan solution of 1,000 cps, which has been made by dissolving carrageenan into hot water of 70° C., with the use of a doctor knife coater and dried with a Yankee type drier to produce a wide sheet. Then, the sheet was cut into a casing of 230 mm width and 300 mm length, folded double and sewn at its edges for making a cylinder of 300 mm length. The cylinder was filled with 250 g sausage, closed with an aluminum clip, boiled at 90° C. for 90 minutes and further smoked and dried to produce a final product. The product produced in this way was excellent with the meat tightly filled without any shrinkage on its surface. The peelability of the casing from the meat was also found excellent and satisfactory as well as the smoked conditions.

Table 1 shows a comparison of physical properties between the casing produced in accordance with the method of the present invention in the Example 1 and the casing impregnated with viscose.

| Test Item | Test Method | Casing with Viscose | Casing in this Invention |
|---|---|---|---|
| | Strength in Dry Condition | | |
| Weight (g/m$^2$) | | | 40.5 |
| Quantity Applied (g/m$^2$) | | 21.0 | |
| Thickness (mm) | JIS P 8118 | 0.072 | 0.075 |
| Rupture (Kg/cm$^2$) | JIS P 8118 | 1.4 | 2.3 |
| Tensile Strength (Kg) | | | |
| Vertical | JIS P 8113 | 5.1 | 4.9 |
| Horizontal | | 2.6 | 4.3 |
| Elongation (%) | | | |
| Vertical | JIS P 8113 | 2.1 | 3.4 |
| Horizontal | | 12.8 | 4.3 |
| Tearing | | | |
| Vertical | JIS P 8116 | 33 | 30 |
| Horizontal | | 29 | 31 |
| | Strength in Wet Condition | | |
| Rupture (Kg/cm$^2$) | JIS P 8112 | 1.0 | 1.3 |
| Tensile Strength (Kg) | | | |
| Vertical | JIS P 8112 | 2.0 | 1.9 |
| Horizontal | | 1.3 | 2.0 |
| Elongation (%) | | | |
| Vertical | | 8.1 | 6.6 |
| Horizontal | | 20.1 | 6.3 |
| Shrinkage After Wetting (%) | | | |
| Vertical | | −0.3 | +0.4 |
| Horizontal | | +6.1 | +0.4 |
| After Redrying | | | |
| Vertical | | −4.0 | −8.1 |
| Horizontal | | −4.3 | −7.9 |

EXAMPLE 2

The Japanese paper of 20 g/m$^2$ was coated and impregnated at the rate of 250 g/m$^2$ with 8% carrageenan solution of 1,000 cps which has been made by dissolving carrageenan into hot water of 70° C., with a use of a doctor knife coated and dried with a Yankee type drier to produce a large sheet. Then, the sheet was cut into a square casing of 450 mm×450 mm, filled with 600 g sausage, formed with a retainer, boiled at 90° C. for 90 minutes and further smoked and dried for producing a final product. The product produced in this way is strong enough to tolerate the forming pressure by a retainer, so that the surface condition was excellent. The peelability of the casing from meat was excellent as well as the smoked condition.

EXAMPLE 3

An unwoven cloth with a net was coated and impregnated at the rate of 1,000 g/m$^2$ with the same carrageenan solution as that in the Example 1 above using a roll coater, dried and manufactured into a casing in the same way as that in the actual Example No. 1, which was filled with meat, boiled and smoked to produce a product. The product produced in this way was satisfactorily good, accompanied with the beautiful finish of the net.

A comparison has been made with the following example:

A Japanese paper coated and impregnated with viscose solution using a roll coater, regenerated, rinsed and desulphurized (neutralized) to be followed by flexibility adding and drying treatments for producing a casing sheet was utilized. The sheet casing produced was filled with the same type of meat as in the Example 1, boiled and smoked. However, the surface of the casing was unevenly wrinkled like vertical strips. When the casing was peeled off, the meat locally adhered to it and was removed together with it so that the surface of the product was partly indented spoiling its outward appearance.

In accordance with the present invention, the casing produced with the above mentioned steps can be used to wrap foods such as a ham, a sausage, and the like made from meat, so that regeneration, rinsing, denaturalization (desulphurization) and flexibility adding treatments are dispensed with. Also, environmental pollution problems caused by effluent and exhaust gas from factories during processing are resolved as well. Moreover, the casing of the product in accordance with the present invention shows the same performance in both boiling and smoking processes as that by the conventional casing impregnated with viscose. It also shows satisfactory peelability and contractability.

Furthermore, during producing conventional casings impregnated with viscose only either natural cellulose or regenerated cellulose must be used as a substrate. It is however advantageous to use chemical fiber made synthetic paper and unwoven cloth, etc., for the substrate in addition to various conventional substrates already used. In accordance with the present invention the chemical fiber made synthetic paper, the unwoven cloth, etc. can be used as well.

Since water soluble natural polysaccharide such as xanthan gum, carrageenan, etc. is used in the invention, only three treatments such as dissolution, coating and drying are needed. Conventional regeneration, rinsing, flexibility adding works are no longer required so that the conventional problems caused by exhaust gases such as carbon disulfide, hydrogen sulfide, etc. and a control of pH, COD, BOD, SS, etc. in effluent from factories do not occur.

As can be seen from Table 1, the strength of the casing produced in accordance with the present invention can be left out of consideration a compared with that of the casing impregnated with viscose. The manufacturability in filling meat into the casing, boiling and smoking during processing a ham, a sausage and the like is excellent, and there is no difference of smoking effect on meat from that by any conventional casings. The contractability is sufficient and the finish is also satisfactorily good.

It will be understood that each of the elements described above, or two or more together, may also find a useful application in other types of methods and products differing from the types described above.

While the invention has been illustrated and described as embodied in methods and products, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of producing a casing for a meat product, comprising the steps of forming a breathable fibrous food-casing sheet, composed of a material selected from the group consisting of Japanese paper, unwoven cloth and cotton cloth; impregnating and filling meshes of the breathable food-casing sheet with a polysaccharide; and drying the impregnated breathable food-casing sheet.

2. A method of defined in claim 1, wherein said impregnating includes coating the breathable fibrous sheet with a polysaccharide.

3. A method as defined in claim 1; and further comprising the step of sewing the impregnated sheet to produce the casing.

4. A method as defined in claim 1; and further comprising heat-sealing the impregnated sheet to produce the casing.

5. A method as defined in claim 1, wherein said polysaccharide is carrageenan.

6. A casing for a meat product, comprising a breathable dry fibrous food-casing sheet composed of a material selected from the group consisting of Japanese paper, unwoven cloth and cotton cloth, said sheet being impregnated with a polysaccharide and having meshes filled with said polysaccharide.

7. A casing as defined in claim 6, wherein said breathable fibrous sheet impregnated with polysaccharide is sewn.

8. A casing as defined in claim 6, wherein said breathable fibrous sheet impregnated with polysaccharide is heat sealed.

9. A casing as defined in claim 6, wherein said polysaccharide is carrageenan.

* * * * *